United States Patent [19]

Bock

[11] Patent Number: 4,643,077

[45] Date of Patent: Feb. 17, 1987

[54] HYDRAULIC RADIAL PISTON MACHINE

[76] Inventor: Rudolf Bock, Palmerstrasse 9, D-7038-Holzgerlingen, Fed. Rep. of Germany

[21] Appl. No.: 770,648

[22] Filed: Aug. 28, 1985

[30] Foreign Application Priority Data

Sep. 11, 1984 [DE] Fed. Rep. of Germany ..... 3433289

[51] Int. Cl.[4] ..... F01B 13/06

[52] U.S. Cl. ..... 91/497; 91/498; 92/12.1

[58] Field of Search ..... 91/475, 491, 497, 498; 92/12.1; 417/221, 219

[56] References Cited

U.S. PATENT DOCUMENTS

| | | | |
|---|---|---|---|
| 2,871,797 | 2/1959 | Bourassa | 91/472 |
| 3,086,477 | 4/1963 | Ruhl | 91/497 |

FOREIGN PATENT DOCUMENTS

| | | | |
|---|---|---|---|
| 1054300 | 4/1959 | Fed. Rep. of Germany | 91/497 |
| 1113633 | 5/1968 | United Kingdom | 91/497 |
| 1221011 | 2/1971 | United Kingdom | 91/497 |
| 1299442 | 12/1972 | United Kingdom | 91/497 |
| 545766 | 3/1977 | U.S.S.R. | 417/221 |

*Primary Examiner*—Carlton R. Croyle
*Assistant Examiner*—Paul F. Neils
*Attorney, Agent, or Firm*—Michael J. Striker

[57] ABSTRACT

A hydraulic radial piston machine for stepplessly displaceable piston stroke has a plurality of pistons which are formed as roller bodies and abut linearly with their circular spherical regions against a control curve which is formed on a control ring displaceable relative to a cylinder body of the machine, wherein the control curve is formed as a symmetrical spatial curve such that the curve regions which form both the inner dead point for the pistons and the outer dead point for the pistons change in the displacement direction of the control ring.

9 Claims, 9 Drawing Figures

Fig. 2
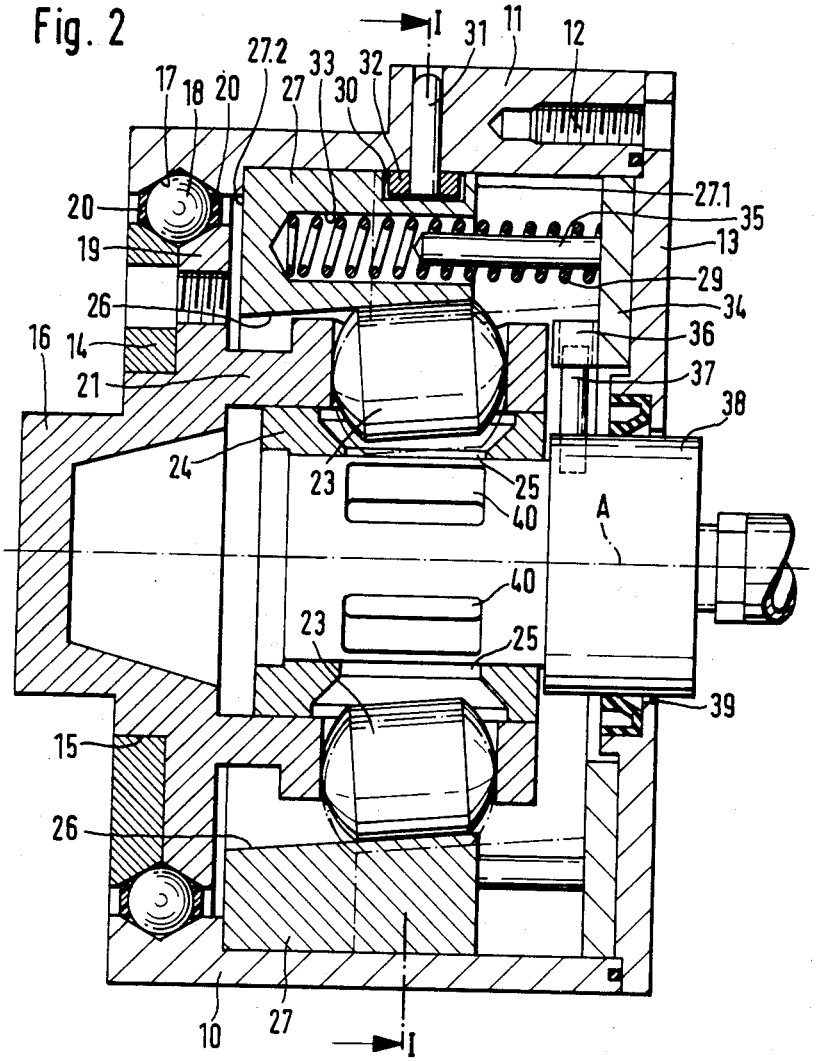
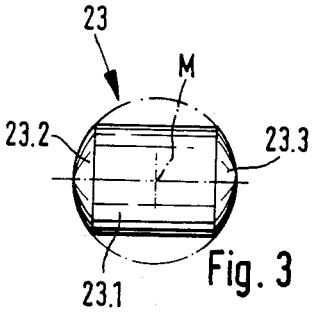
Fig. 3
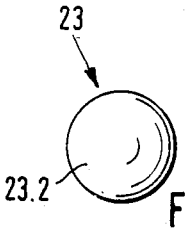
Fig. 4

HYDRAULIC RADIAL PISTON MACHINE

BACKGROUND OF THE INVENTION

The present invention relates to a hydraulic radial piston machine with steplessly adjustable piston stroke. More particularly, this invention relates to a hydraulic radial piston machine with a rotary cylinder body arranged concentrically to a control pin, and a plurality of pistons which are formed as roller bodies, arranged symmetrically over the periphery of the cylinder and roll on a control curve which is adjustable relative to the cylinder body.

Radial piston machines are known with pistons formed as balls with which only a peripheral line of the ball seals in the cylinder opening and the ball roll over the control curve. It is known in these cylindrical radial piston machines, for changing the piston stroke, to displace the control curve which is generally formed on the inner side of the machine housing about an axis which extends parallel to a rotor of the machine and in direction transverse to the longitudinal direction of the rotor. The control curve can be purely circular curve.

With the use of hydraulic radial piston machines in a hydrostatic drive arrangement for vehicles, a stepless adjustment of the radial piston machine which is formed as a motor is required. Moreover, a compact, space economical construction is desired so as to use such a radial piston machine as a hub motor for the drive wheels of a vehicle. The known radial piston machines with steplessly adjustable piston stroke have the disadvantage in that they have an expensive construction which requires in powerful machines a relatively great space consumption and increases their failure susceptibility. Also, the known radial piston machines in which the pistons are formed as roller bodies and particularly as balls are not suitable for the above-mentioned purposes, since the specific pressure because of the point abutment of the ball-shaped pistons allows with the strength values and respective elasticity coefficients of conventional piston material only a small relative oil pressure independently on the machine dimensions, wherein this oil pressure is very low for the use in the vehicle drive arrangements.

SUMMARY OF THE INVENTION

Accordingly, it is an object of the present invention to provide a hydraulic radial piston machine which avoids the disadvantages of the prior art.

More particularly, it is an object of the present invention to provide a hydraulic radial piston machine which is formed so that with relatively simple and compact construction it can operate with higher oil pressures than the known radial piston machines with pistons formed as rolling bodies.

In keeping with these objects and with others which will become apparent hereinafter, one feature of the present invention resides, briefly stated, in a hydraulic radial piston machine in which the pistons formed as roller bodies abut with a circular cylindrical region against a control curve linearly and arranged in a cylinder body with their axes of rotation tiltably about a relatively small angular region, and the control curve is formed as a symmetrical spatial curve on an adjustable control ring which is axes-parallel to a cylinder body so that in the adjustment direction of the control ring the curve regions which form both the inner dead point for the piston and the outer dead point for the piston change. The control curve advantageously can be formed on the inner side of such control ring which concentrically surrounds the rotary cylinder body and is adjustable in an axial direction against the force of springs abutting against its end sides.

When the hydraulic radial piston machine is designed in accordance with the present invention it can be very compact and at the same time can have a shorter structural length with a smaller outer diameter of a cylindrical housing. Because of the linear contact of the roller bodies-pistons in a circular cylindrical central region, the radial piston machine has a high specific pressure of the hydraulic working medium. Because of the special construction of the spatial curve which advantageously is symmetrical in two mutually normal spatial planes which during its axial displacement simultaneously produced a change in the inner and outer dead point positions of the pistons, only a relatively short adjustment path of the control ring provided with the control curve is required which is favorable for short structural length of the radial piston machine. In the control curve displacement, the pistons maintain (because of their limited tiltable arrangement in the cylinder), always their linear abutment against the control curve without causing because of their tilting movement over a relatively short angular region of a significant leakage gap between the pistons and the cylinder wall. The sufficient sealing of the cylinder chamber is faborable because of the shaping of the piston, such that the pistons formed as roller bodies are provided advantageously with spherical portions on both ends of the circular cylindrical central portion, and the diameter of the cylinder openings of the cylinder body corresponds to an axial cross-section of the pistons.

Because of the cylindrical construction of the control curve, in the inventive hydraulic radial piston machine a complete compensation of the occuring forces is provided so that the bearing points of the machine can be dimensioned in a favorable manner. Moreover, with this construction of the control curve as a symmetrical spatial curve, the feed stream or the oil receipt can be selected constant.

With the use of the hydraulic radial piston machine as a motor, a load-dependent automatic adjustment of the control curve is possible and therefore an automatic matching of the piston stroke to the motor loading is provided. In accordance with the present invention, the control ring which is provided with the control curve for this purpose is axially displaceable and rotatable in the housing, and a plurality of guiding grooves are provided on its circular cylindrical outer surface, which are helical and uniformly distributed over the periphery, and a guiding pin which is mounted in the housing and provided with a guiding roll supported thereon extends in the guiding grooves. For maintaining this action in both rotary directions, the guiding grooves for the individual guiding pin can each extend from an initial point both in one and in another peripheral direction at the same pitch angle. The torque which acts during loading on the rotor acts positively also on the control curve as a reaction moment and provide because of the guiding groove arrangement an axial screwing of the control ring against the force of springs which load the same. A predetermined rotation of the control ring which is provided with the control curve corresponds to an axial adjustment of the control ring and a corresponding adjustment of the control stroke from a position of a smallest distance stroke in direction to the position of a greatest system stroke. With the use of the piston machine as a pump, the control curve is advantageously formed so that it operates in its end position and initial position as a zero supply or in other words a smallest piston stroke.

When the radial piston machine in accordance with the present invention is formed as a motor, it is another feature of the present invention that during the above-mentioned rotation of the control ring for avoiding a change of the control times, the control pin can be coupled co-rotatingly with the control ring. In accordance with an advantageous embodiment, the control ring can be formed with helical springs which load it at one side and extend between the bodies of blind holes provided on one side of the control ring, on the one hand, and a ring disc coaxially rotatable in the housing on the other hand. The ring disc is provided with pins which extend into the helical pressure springs and with driving projections arranged so that a web which radially extends from the floatingly arranged control pin abuts against the driving projections. The control pin which is floatingly arranged in the rotor of the motor, is also not rigidly coupled with the control ring. The pressure springs extend with their greater part into the blind holes of the control ring in which also the driving pins which pass inside the helical pressure springs extend. Because of this arrangement a short structural length of the machine is provided. Outside adjusting devices for the control ring can be completely dispensed with, and the machine housing can be connected in the radial direction over the entire periphery directly with the control ring, whereby a small axial size of the machine is obtained.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

FIG. 2 is a view showing an angular cross-section of the machine in accordance with the present invention taken alone the line II—II in FIG. 1;

FIGS. 3 and 4 are views showing a side and an end of a piston formed as a rolling body of the machine of the present invention;

DESCRIPTION OF THE PREFERRED EMBODIMENTS

Figure 1:
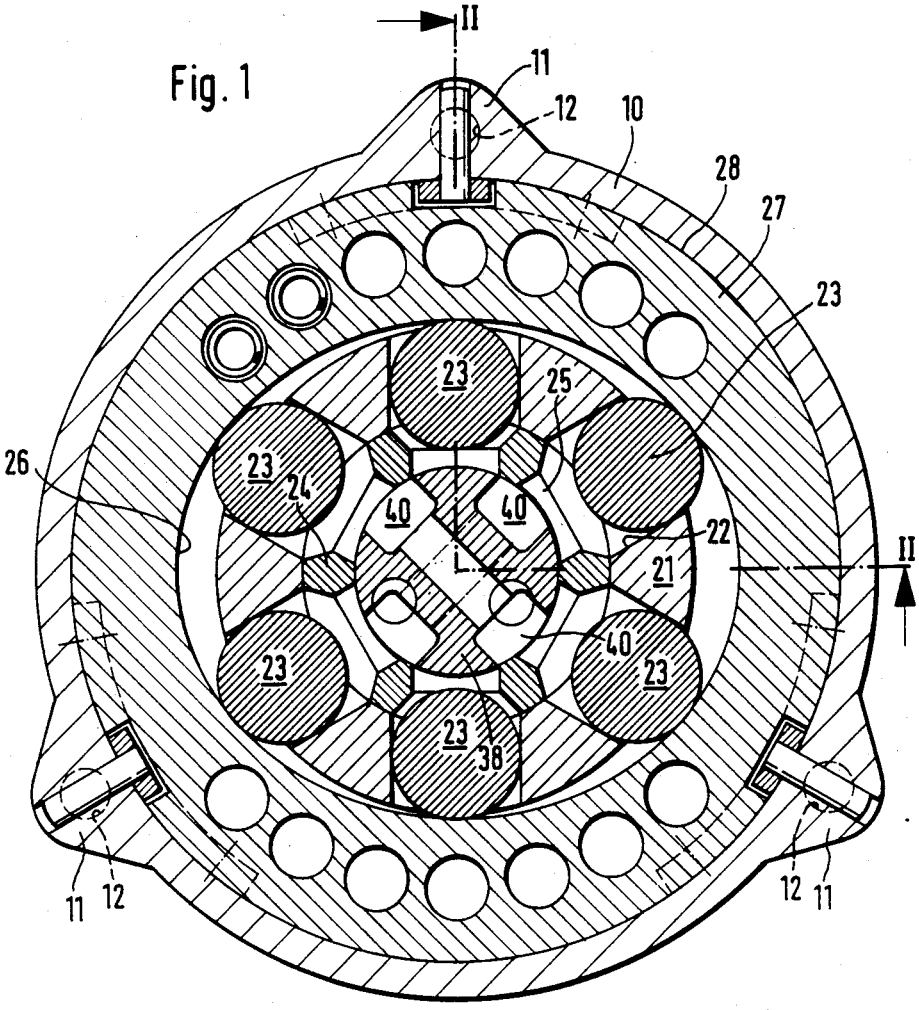
FIG. 1 is a view showing a central cross-section of a radial piston machine in accordance with the present invention, taken along the line I—I in FIG. 2.

A hydraulic radial piston machine in accordance with the present invention has a cylindrical housing 10 provided with three convex portions 11 which are symmetrically distributed over the periphery of the housing. The convex portions 11 have threaded openings 12 which have axes extending parallel to one another.

A collar 13 is mounted on one side of the housing by means of screws which pass through the threaded openings 12 of the convex portions 11 of the housing. A mounting ring disc 14 closes the opposite side of the housing 10 and is arranged on an outer flange 19 of the rotor. The mounting ring disc 14 is provided with a central opening 15. A closed end 16 of the shaft of the rotor extends through the opening 15. The outer sides of the mounting ring disc 14 and the outer flange 19, on the one hand, and the opposite inner side of the housing 10, on the other hand, form ring grooves 17. The ring grooves 17 are bearing grooves for balls 18 of a four-point roller bearing which supports the rotor in the housing 10 in a play-free manner. The four-point roller bearing is sealed by means of synthetic plastic seals 20. The mounting ring disc 14 serves, for example, for mounting a braking disc of a vehicle wheel, when the radial piston machine in accordance with the present invention is used as a hub motor for a vehicle wheel.

A hollow-cylinder main part of the rotor forms a cylinder body 21 provided with six through-going openings 22 which are shaped as elongated holes and uniformly distributed over the periphery of the cylinder body 21. The openings 22 are formed as cylinder openings. Pistons 23 which are formed as roller bodies are arranged in the cylinder openings 22 and have the cross-section with a shape corresponding to the shape of the cylinder openings 22. FIGS. 3 and 4 show individually one of the pistons 23. It has a circular cylindrical central part 23.1 which transits at both ends into a spherical portion 23.2 and 23.3. In the shown embodiment the spherical portions 23.2 and 23.3 are portions of a seal whose central point M is located in a center of the piston 23.

A distributing bush 24 is arranged in a play-free manner in the hollow cylindrical cylinder body 21 and is provided with openings 25 which face toward the cylinder openings 22. The pistons 23 can be inserted into the openings 25 and their cross-section is selected so that a through-tilting of the pistons 23 in the cylinder body 21 is prevented.

Figure 5:
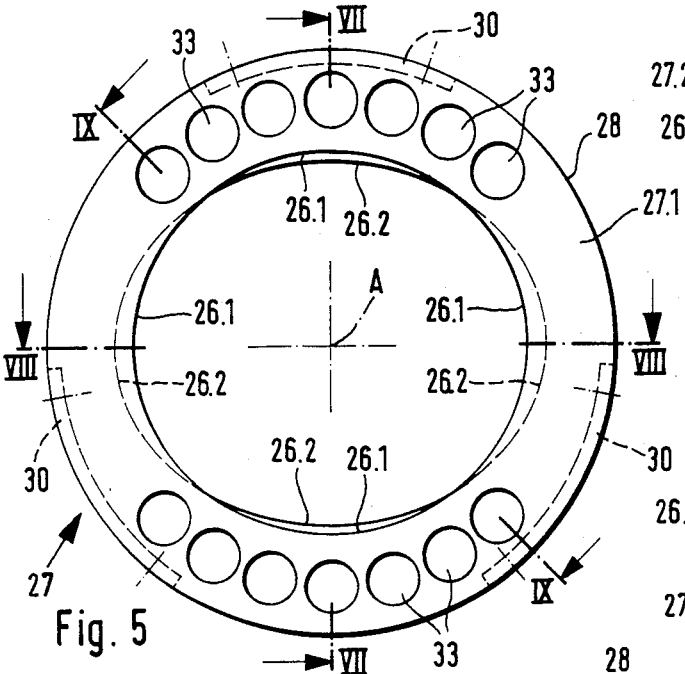
FIG. 5 is a view showing a control ring of the machine, as seen from its end side.
Figure 7:
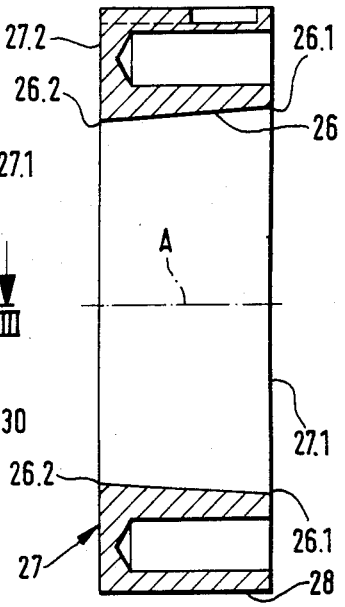
FIG. 7 is a view showing a cross-section through the control ring, taken along the line VII—VII in FIG. 5.
Figure 8:
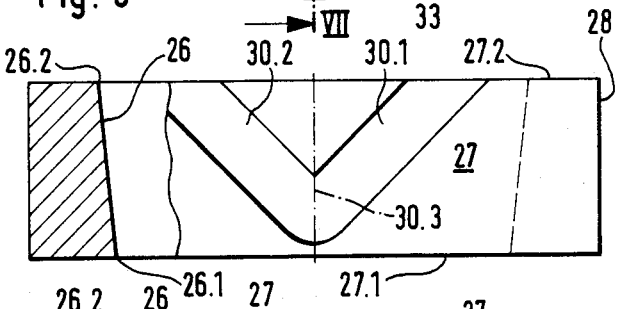
FIG. 8 is a view showing a control ring, turned relative to FIG. 5 by 90° and partially in section taken along the line VIII—VIII in FIG. 5.
Figure 9:
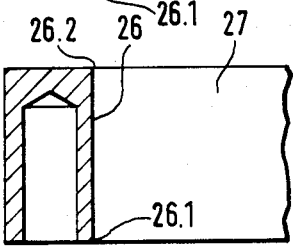
FIG. 9 is a view showing a partial section of a control ring along the line IX—IX in FIG. 5.
Figure 6:
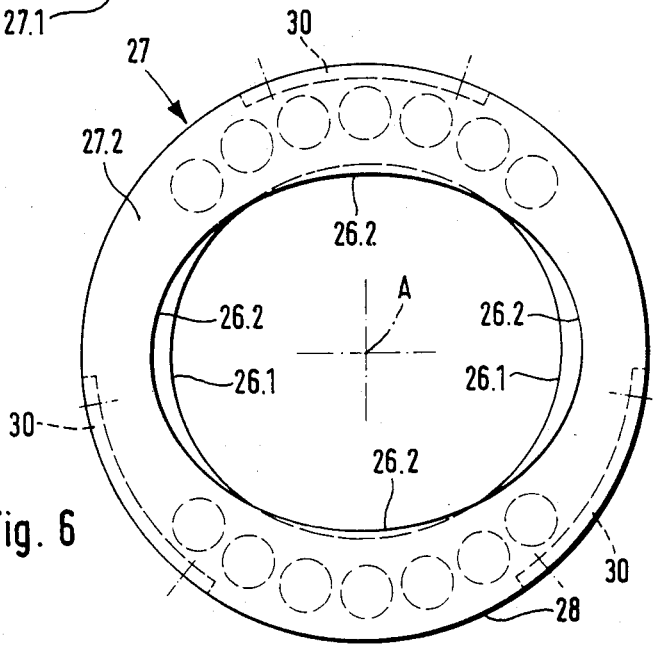
FIG. 6 is a view showing another end side of the control ring of the present invention.

The pistons lie with their circular cylindrical central portion 23.1 linearly on a control curve 26 which is formed on an inner side of a control ring 27, as shown in detail in FIGS. 5–9. The control ring 27 is inserted fittingly in the housing 10 with sliding feet, with its circular cylindrial outer surface 28. FIG. 5 shows a front end side 27.1 and FIG. 6 shows a rear end side 27.2 of the control ring 27. FIGS. 7–9 show longitudinal sections of the control ring 27 at different peripheral points. FIGS. 2 and 7–9 clearly illustrate the rectilinearness of the control curve 27 in the abutment direction of the circular cylindrical central portion 23.1 of the pistons 23. The different peripheral lines of the control curve on the front end side 27.1 and on the rear end side 27.2 of the control ring 27 can be seen from FIGS. 5 and 6.

The peripheral line of the control curve 26 on the front end side 27.1 is identified with reference numeral 26.1, and the peripheral line of the control curve 26 on the read end side 27.2 is identified with reference numeral 26.2. The peripheral line 26.1 determines a smallest piston stroke while the peripheral line 26.2 of the control curve 26 determines a maximum possible piston stroke. The control curve 26 is also formed as a spatial curve which, during an actual displacement of the control ring 27, changes the curve regions which form both the inner dead point for the pistons and the outer dead point for the pistons. The cross-section shows that the control curve 26 from a parallel position of FIG. 9 forms inside a relatively small angular region alternating inclined positions for a longitudinal axis of the rotor and the control ring 27 and respectively alternating abutment lines for the piston 23. This results in an easy tilting movement of the pistons 23 in the cylinders which can follow the pistons because of their shape without significant sealing change. The peripheral line 26.1 of the curve 26 which determines the smallest piston stroke has an approximately circular shape in FIG. 5 and can have a completely circular shape when the machine is formed as a pump for obtaining a zero feed. The peripheral line 26.2 for the maximum stroke of the piston has in FIG. 6 a strongly oval course. The total piston stroke displacement can be driven so far that when the machine is formed as a motor, the maximum stroke of the piston provides the doubled feed quantity as compared with the predetermined minimum stroke of the piston.

The machine shown in the drawing is formed for its use as a motor. The control ring 27 is prestressed by means of helical pressure springs 29 shown in FIG. 2 to an initial position illustrated in this Figure. In this initial position the control curve 26 acts with the region of its peripheral line 26.1 upon the pistons 23 in direction of a minimum piston stroke. The cylindrical outer periphery 28 of the control ring 27 is provided at three points with helically extending guiding grooves 30 which in the projection are V-shaped as can be seen in FIG. 8. Both groove portions 30.1 and 30.2 form thread convolutions which extend from their connecting point 30.3 in opposite peripheral direction with the same pitch. A guiding roller 32 extends in the V-shaped guiding groove 30 and is rotatably supported on a guiding pin 31 which is radially mounted in the housing 10, as shown in FIG. 2. In the initial position of the control ring 27 shown in FIG. 2, the guiding roller 32 is located in the connecting point 30.3 of the guiding groove 30 illustrated in FIG. 8.

The helical pressure springs 29 are inserted in two opposite peripheral regions of the control ring 27 respectively in a blind hole 33 open inwardly toward the end side 27' of the control ring 27. As can be seen from FIG. 5, seven such blind holes 33 are formed in both peripheral regions. The helical pressure springs 29 are supported on the one hand, on the bottoms of the blind holes 33 and, on the other hand, on a ring disc 34 which freely rotatably abuts against the collar 13. At least one driving pin 35 extends from the ring disc 34 into one helical pressure spring 29 and to the associated blind holes 33 of the control ring 27. Driving projections 36 are mounted on the ring disc 34 and extend between a radial pin or web 37. The web 37 is mounted on a central control pin 38 of the machine which extends through a central opening 39 in the cover 13 in a free floating manner in the distributing bush 24. In the known manner, the central control pin 38 has openings 40 which face toward openings 25 of the distributing bush and are provided for supply and discharge of the hydraulic fluid to and from the cylinders.

The axial displacement of the control ring 27 in the housing is performed positively by an action torque which is derived from the loading torque of the cylinder body on the control ring 27 acting at the rotor. Under the action of the reaction torque the control ring 27 is guided against the force of the helical springs 29 to the right in FIG. 2 in direction to the collar 13 of the housing 10 by the guiding rollers 32 which run in the grooves 30, practically positively, while the pistons 23 obtain by means of a control curve 26 a greater stroke. The resulting turning of the control ring 27 is transmitted via at least one guiding pin 35 to the ring disc 34 and via the radial pins 37 further to the control pin 38 of the machine. The control pin 38 takes along the limited rotary movement of the control ring 27.

The axial displacement of the control ring 27 can also be performed in a different manner.

It will be understood that each of the elements described above, or two or more together, may also find a useful application in other types of constructions differing from the types described above.

While the invention has been illustrated and described as embodied in a hydraulic radial piston machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A hydraulic radial piston machine with steplessly adjustable piston stroke, comprising a control pin; a rotatable cylinder body arranged concentrically to said control pin and having a plurality of openings; a plurality of pistons which are formed as rolling bodies and distributed symmetrically over a periphery of said cylinder body in said openings; and means forming a control curve which is displaceable relative to said cylinder body and over which said pistons roll, said pistons having a circular cylindrical region which linearly abut against said control curve, said pistons being arranged in said cylinder body tiltably with their axes of rotation in a relatively small angular region; and a control ring axis-parallel with and displaceable relative to said cylinder body, said control curve being formed on said control ring as a symmetrical spatial curve such that said pistons are tilted by said curve within said openings, and the curve regions which form both an inner dead point for said pistons and an outer dead point for said pistons change in direction of displacement of said control ring.

2. A hydraulic radial piston machine as defined in claim 1, wherein said control ring concentrically surrounds said cylinder body and has an inner side, said control curve being formed on said inner side of said control ring, said control ring having two end sides; and further comprising spring means engaging with one end side of said control ring so that said control ring is displaceable in an axial direction against the force of said spring means.

3. A hydraulic radial piston machine as defined in claim 1, wherein said circular cylindrical central region of each of said pistons has two ends, each of said pistons being provided with a spherical portion at each of said ends of said central portion.

4. A hydraulic radial piston machine with steplessly adjustable piston stroke, comprising a control pin; a rotatable cylinder body arranged concentrically to said control pin; a plurality of pistons which are formed as rolling bodies and distributed symmetrically over a periphery of said cylinder body; and means forming a control curve which is displaceable relative to said cylinder body and over which said pistons roll, said pistons having a circular cylindrical region which linearly abut against said control curve, said pistons being arranged in said cylinder body tiltably with their axes of rotation in a relatively small angular region; and a control ring axis-parallel with and displaceable relative to said cylinder body, said control curve being formed on said control ring as a symmetrical spatial curve such that the curve regions which form both an inner dead point for said pistons and an outer dead point for said pistons change in direction of displacement of said control ring, said circular cylindrical central region of each of said pistons having two ends, each of said pistons being provided with a spherical portion at each of said ends of said central portion and having a predetermined cross-section, said cylinder body having a plurality of openings for receiving said pistons, said cylinder openings having a diameter corresponding to said axial cross-section of said pistons.

5. A hydraulic radial piston machine with steplessly adjustable piston stroke, comprising a control pin; a rotatable cylinder body arranged concentrically to said control pin and having a plurality of openings; a plurality of pistons which are formed as rolling bodies and distributed symmetrically over a periphery of said cylinder body within said openings; and means forming a control curve which is displaceable relative to said cylinder body and over which said pistons roll, said pistons having a circular cylindrical region which linearly abut against said control curve, said pistons being arranged in said cylinder body tiltably with their axes of rotation in a relatively small angular region; and a control ring axis-parallel with and displaceable relative to said cylinder body, said control curve being formed on said control ring as a symmetrical spatial curve such that the curve regions which form both an inner dead point for said pistons and an outer dead point for said pistons change in direction of displacement of said control ring, said control ring concentrically surrounding said cylinder body and has an inner side, said control curve being formed on said inner side of said control ring, said control ring having two end sides; spring means engaging with one end side of said control ring so that said control ring is displaceable in an axial direction against the force of said spring means; a housing; a ring disc arranged coaxially rotatable in said housing, said one side of said control ring being provided with blind openings having bottoms, and said spring means including helical pressure springs arranged between said bottoms of said blind holes of said control ring on the one hand and said ring disc on the other hand.

6. A hydraulic radial piston machine with steplessly adjustable piston stroke and formed as a hydraulic motor, comprising a control pin; a rotatable cylinder body arranged concentrically to said control pin and having a plurality of openings; a plurality of pistons which are formed as rolling bodies and distributed symmetrically over a periphery of said cylinder body within said openings; and means forming a control curve which is displaceable relative to said cylinder body and over which said pistons roll, said pistons having a circular cylindrical region which linearly abut against said control curve, said pistons being arranged in said cylinder body tiltably with their axes of rotation in a relatively small angular region; and a control ring axis parallel with and displaceable relative to said cylinder body, said control curve being formed on said control ring as a symmetrical spatial curve such that the curve regions which form both an inner dead point for said pistons and an outer dead point for said pistons change in direction of displacement of said control ring; a housing; a plurality of guiding pins mounted in said housing and each provided with a guiding roller supported thereon, said control ring being axially displaceable and rotatable in said housing and having a circular cylindrical outer surface provided with a plurality of helically extending guiding grooves which are uniformly distributed over its periphery, said guiding pins with said guiding rollers extending into said guiding grooves.

7. A hydraulic radial piston machine as defined in claim 6, wherein each guiding groove has two groove portions connected with one another in a connecting point and extending in both peripheral directions from said point with equal pitch angles.

8. A hydraulic radial piston machine as defined in claim 6, wherein said control pin is coupled with said control ring so that it rotates with the latter.

9. A hydraulic radial piston machine as defined in claim 6, wherein said ring disc has at least one driving pin extending into one of said helical pressure springs, said ring disc also having a driving projection, said control pin being arranged floatingly and having a radially projecting web which abuts against said driving projection.

* * * * *